US006158902A

United States Patent [19]

Staat

[11] Patent Number: 6,158,902

[45] Date of Patent: Dec. 12, 2000

[54] BOUNDARY LAYER MICROPHONE

[75] Inventor: Raimund Staat, Burgwedel, Germany

[73] Assignee: Sennheiser electronic GmbH & Co. KG, Wedemark, Germany

[21] Appl. No.: 09/015,655

[22] Filed: Jan. 29, 1998

[30] Foreign Application Priority Data

Jan. 30, 1997 [DE] Germany ..... 197 03 311

[51] Int. Cl.[7] ..... H04R 25/00

[52] U.S. Cl. ..... 391/357; 381/338; 381/345; 381/355; 381/356

[58] Field of Search ..... 381/355, 356, 381/357, 358, 359, 360, 353, 354, 338, 91, 92, 336, 345

[56] References Cited

U.S. PATENT DOCUMENTS

| | | | |
|---|---|---|---|
| 4,421,957 | 12/1983 | Wallace, Jr. . | |
| 4,434,507 | 2/1984 | Thomas | 455/95 |
| 4,757,546 | 7/1988 | Akino | 381/155 |
| 4,836,326 | 6/1989 | Wehner | 181/144 |
| 5,033,090 | 7/1991 | Weinrich | 381/353 |
| 5,168,525 | 12/1992 | Müller . | |
| 5,682,418 | 10/1997 | Ide | 379/58 |
| 5,703,957 | 12/1997 | McAteer | 381/355 |
| 5,848,172 | 12/1998 | Allen et al. | 381/356 |

FOREIGN PATENT DOCUMENTS 536066 10/1938 United Kingdom .

969000 10/1960 United Kingdom .

*Primary Examiner*—Stella Woo
*Assistant Examiner*—Dionne Harvey
*Attorney, Agent, or Firm*—Reed Smith Shaw & McClay LLP

[57] ABSTRACT

A boundary layer microphone is disclosed. Boundary layer microphones have been known for some considerable time. One example is the MKE 212 P microphone type made by Sennheiser electronic GmbH & Co. KG. The latter is a permanently polarized condenser microphone for concealed mounting in a wall, on the floor or on a table. Stereo recordings using such a boundary layer microphone are especially clear, creating a spatial impression of unusual breadth. The known boundary layer microphone MKE 212 P displays omnidirectional characteristics and a frequency range of 20 to 20,000 Hz. The disclosed boundary layer microphone is designed to increase the directional characteristics compared to a boundary layer microphone of the aforementioned type, and to reduce or eliminate the problems associated with same. This is achieved by a boundary layer microphone having at least one sound tunnel running underneath the plate surface, the plate having at least one opening to the sound tunnel. The transducer is located inside the sound tunnel and the transducer opening through which sound enters is positioned in the direction of the sound tunnel.

10 Claims, 11 Drawing Sheets

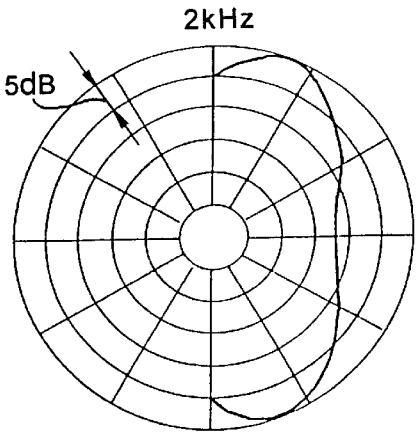
FIG. 13a
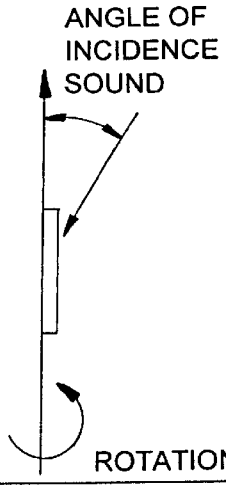
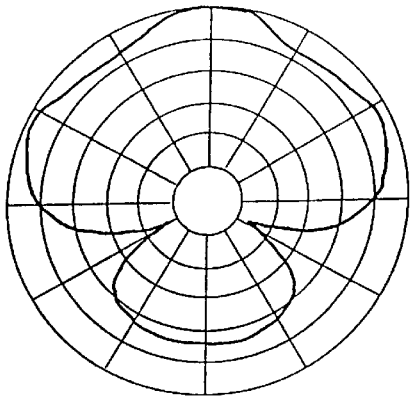
FIG. 13b
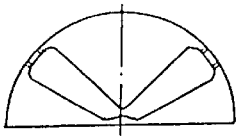
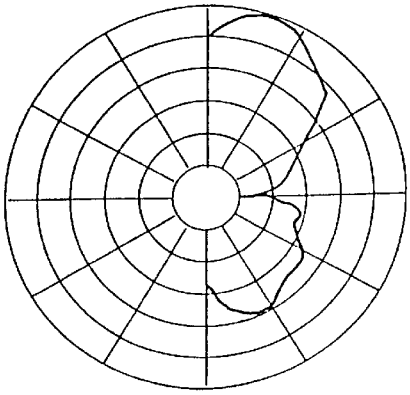
FIG. 13c
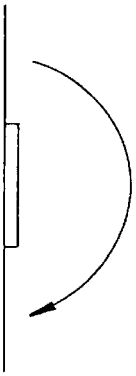

BOUNDARY LAYER MICROPHONE

BACKGROUND OF THE INVENTION

1. Field of the Invention

The present invention relates to a boundary layer microphone also called an interfacial microphone.

2. Description of the Related Art

Boundary layer microphones have been known for some considerable time. One example is the MKE 212 P microphone type made by Sennheiser electronic GmbH & Co. KG, Germany. The latter is a permanently polarized condenser microphone for inconspicuous mounting in a wall, on the floor or on a table. Stereo recordings using such a boundary layer microphone are especially clear, creating a spatial impression of unusual breadth. The known boundary layer microphone MKE 212 P displays omnidirectional characteristics and a frequency range of 20 to 20,000 Hz.

However, the polar response of such boundary layer microphones is the same for every direction of incident sound. In certain applications, e.g., recording speech or music, and particularly in conference equipment, it is preferable to focus the sensitivity of the microphone in the direction of a speaker or musician. It is then necessary to filter out secondary noises, reverberations as well as other speakers or musicians. At the same time, however, the known benefits of boundary layer microphones are to be utilized. Mounting these microphones on large boundary surfaces, such as floors, walls, tables, lecterns, or similar furnishings or appliances with large surfaces prevents the unwanted comb filter effects that are caused by reflections from large nearby boundaries such as the floor or a table. The comb filter results in extreme distortion of the frequency response curve, which then undulates considerably, with deep notches.

Boundary layer microphones with directional characteristics, as known, for example, from the paper entitled "BOUNDARY-LAYER MICROPHONES WITH DIRECTIONAL CHARACTERISTICS" by Beckmann, "AES 75th Convention 1984 March 27–30, Paris", are used more and more often in conferencing facilities or in film and television production because they can be mounted very inconspicuously. In most cases, electret condenser microphone capsules with cardioid or super-cardioid characteristics are used, which are mounted above or inside a flat surface. These capsules mostly have a very weak bass response, a high level of inherent self-noise and a very unfavorable dependence of frequency response on directional characteristics. It declines rapidly at frequencies above 2,000 Hz or so, is lost entirely in many cases, or the microphone is even more sensitive from behind than from the front in some parts of the frequency range. This is due to precisely the type of mounting in front of or in a boundary surface, which is not entirely without its specific problems. Reflections between the microphone and the boundary may be generated, as may resonance effects in the cavities in which the sound must be "diverted" to the front or rear sound inlets of the microphone capsules.

OBJECT AND SUMMARY OF THE INVENTION

The primary object of the present invention is, therefore, to increase the directional characteristics compared to a boundary layer microphone of the aforementioned type, and to reduce or eliminate the problems associated with same.

This is achieved in the present invention by a boundary layer microphone having at least one sound tunnel running underneath the plate surface, the plate having at least one opening into the sound tunnel, the transducer being located inside the sound tunnel and the transducer inlet through which sound enters being positioned in the direction of the sound tunnel.

The known boundary layer microphone MKE 212 features a sound transducer located inside a plate. Above the sound transducer, a dome-like gauze is formed through which the sound can penetrate to the sound inlet of the transducer.

By integrating a sound tunnel in a plate underneath the plate surface in accordance with the present invention, and by locating the transducer inside the sound tunnel, the latter functions like an interference tube (IT), in which waves are emanated from every opening in the tunnel that are not phase coherent and which interfere in such a way that the microphone sensitivity becomes highly directional. Directionality is normally desired also for middle and lower frequencies, typically in the range below 1 kHz. To achieve this, the interference tube must be fitted with a pressure gradient transducer, e.g., a cardioid microphone capsule. When combined with the boundary surface, the result is a so-called lobar or super-cardioid directional pattern, respectively, for the upper and lower frequency range, and a directional range of approximately 30–60° for the hemisphere above the boundary surface. In the directional pattern, the influence of the boundary surface is manifested as a reduction in microphone sensitivity of about 6 dB at 0° exposure, i.e., incident sound waves that effectively glance off. These 6 dB and an additional 6 dB that can typically be achieved by the interference tube enable up to 12 dB in total and are the gain in microphone sensitivity in the main direction or incident sound compared to the bare microphone capsule for constant inherent noise. This is supplemented by the stronger forces imposed on the diaphragm of the microphone capsule by low frequencies as a result of the interference tube. This effect, and the particularly efficient filtering out of unwanted sounds outside the main direction of response increases as the length of the interference tube increases.

The sound inlets of the interference tube may be located almost flush with the surface of the plate described. They are thus directed at the hemispherical space situated above them. Therefore, the sound waves do not need to travel around the interference tube in order to enter all the inlets, which is the cause of cancellation effects at high frequencies in microphones that are not mounted in boundary layers. Even high frequency sound waves reach all inlets without restriction, since the interference tube is exposed to incident sound waves on only one side. Inside the interference tube, the channeling of sound does not deviate in any significant way from that in conventional tube-type directional microphones. This prevents interference effects due to integrating the interference tube into the plate, contrasting, for example, with boundary layer microphones that have cardioid microphones only. On the contrary, a flat plate enables the cross-sectional area to be kept sufficiently large. The size of the latter may be increased as an oval or rectangular shape within the plate. A sufficiently large cross-section is preferred, above all when the sound tunnel is to be long, due to the aforementioned benefits, and the plate kept flat in order to prevent interference from diffraction at the edges. A sound tunnel with too small a cross-section produces too great a resistance against the sound waves travelling towards the microphone capsule, and prevents the interference effect mentioned above.

An embodiment of the boundary layer microphone in accordance with the present invention displays a very high directionality of response, especially at high frequencies, the frequency response curve is flattened over the entire frequency range, a good bass response and a lower proportion of inherent self-noise is attained, and yet a small, inconspicuous microphone is created as is needed in many situations. Depending on which type of directional pattern is required, several sound tunnels may be formed, arranged at predefined angles to each other, e.g., 90°, or at a certain distance from each other, e.g., 170 mm, whereby each sound tunnel is assigned its own sound transducer. In this way, the microphone can be optimized for commonly used stereo recording techniques, such as XY or ORTF, or for the typical conference or talk-show situation.

It is also possible to arrange a microphone capsule at either end of a sound tunnel. In this case, both microphone capsules use the full length of the same tunnel. This saves the need for another tunnel, yet achieves the full directional focusing and bass response that, as mentioned, increase with increasing length of the tunnel. This arrangement is optimally suited, for example, for conferences at which the participants sit opposite each other.

Instead of assigning each tunnel a separate output signal, it is possible, of course, to add or subtract the signals of the separate microphone capsules, or to assign several sound tunnels to only one microphone capsule in the arrangement described above, in order to attain a directional response that is particularly well suited to a certain recording situation. The recording angle is then increased to the left and right according to the angle that is bound by the sound tunnels in their entirety. The suppression of unwanted sound travelling vertically to the plate is retained.

In place of the separate tunnels leading to a transducer, a sound tunnel can be progressively widened towards the end situated opposite the microphone capsule. The sound inlets in the tunnel may take the form of long rows of holes that are situated increasingly close to each other towards the capsule, or an array of holes with an uneven distribution of holes in the simplest case. In this way, a preferred recording direction can be produced, which extends from the plate like an oval ball with an angle of approximately 30°. This enables a speaker or musician, for example, to be recorded in full using only one microphone, or to permit a single actor greater mobility while still filtering out unwanted sounds.

Below, the invention is described in greater detail using drawings of an embodiment.

BRIEF DESCRIPTION OF THE DRAWINGS

In the drawings:

FIGS. 13*a*–13*c* show frequency response diagrams for the boundary layer microphone of FIG. 11 under different conditions of exposure to sound.

DESCRIPTION OF THE PREFERRED EMBODIMENTS

Figure 1:
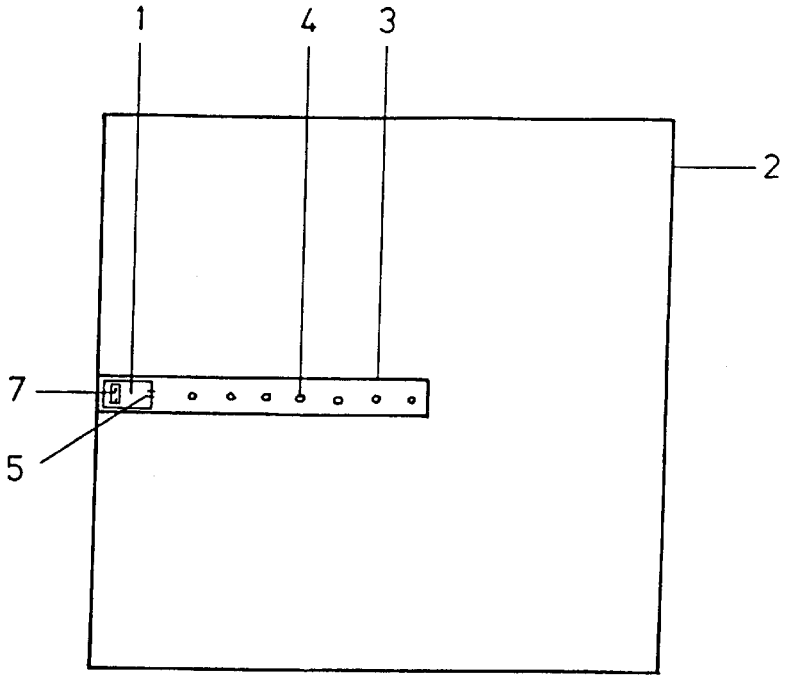
FIG. 1 is a cross-section showing an embodiment of the boundary layer microphone of the present invention.

FIG. 1 show a cross-section of a boundary layer microphone, seen from above. The boundary layer microphone consists of a plate 2 within which a blind hole 3 is bored underneath the upper surface of the plate. A sound transducer 1 is located inside the blind hole 3, this transducer having a first sound inlet 5, which points in the direction of the borehole 3. An additional sound inlet 7 points in a different angle, namely, in the example to the first sound inlet 5, in other words, to the viewer. In addition, borehole 3, which forms a sound tunnel (interface tube), has several openings 4, through which the sound is able to travel into the sound tunnel and hence to the sound transducer 1.

Figure 2:
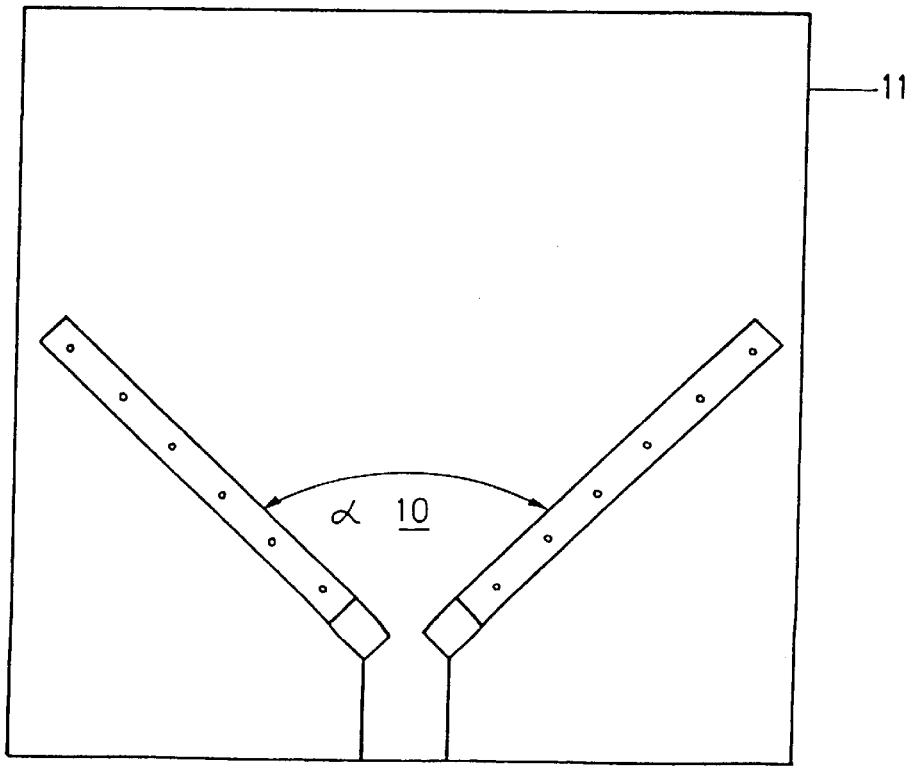
FIG. 2 illustrates an alternative embodiment of a boundary layer microphone of the present invention.

FIG. 2 shows an alternative embodiment of a boundary layer microphone to that in FIG. 1, featuring two sound tunnels arranged at an angle $\alpha$ to each other. The angle $\alpha$ may be 90°, as shown in FIG. 2, or 180°, for example.

Figure 3:
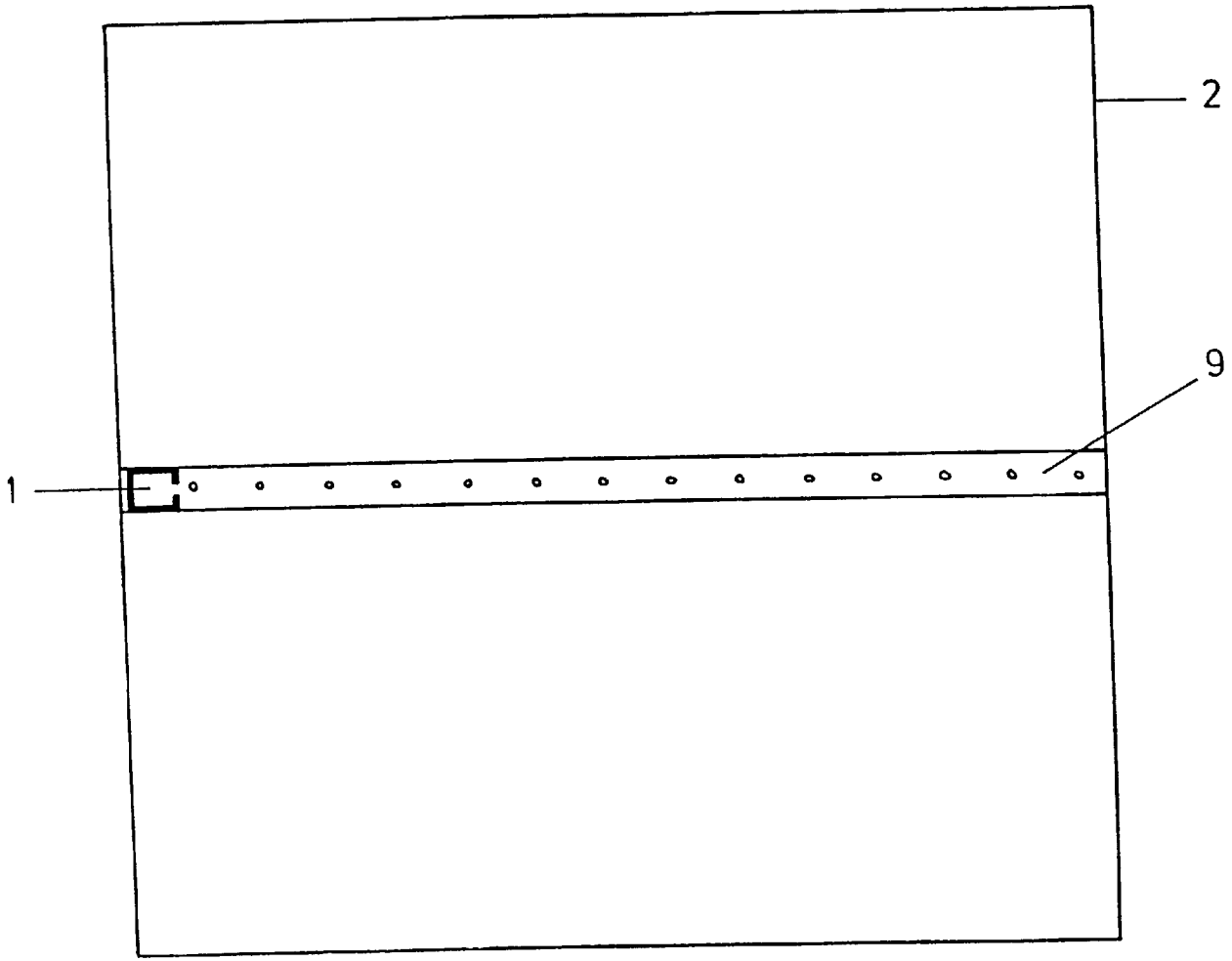
FIG. 3 shows a cross-sectional view of another alternative embodiment of the present invention.

FIG. 3 shows a further example of a boundary layer microphone of the present invention, in which hole 3 is executed as a through hole.

Figure 4:
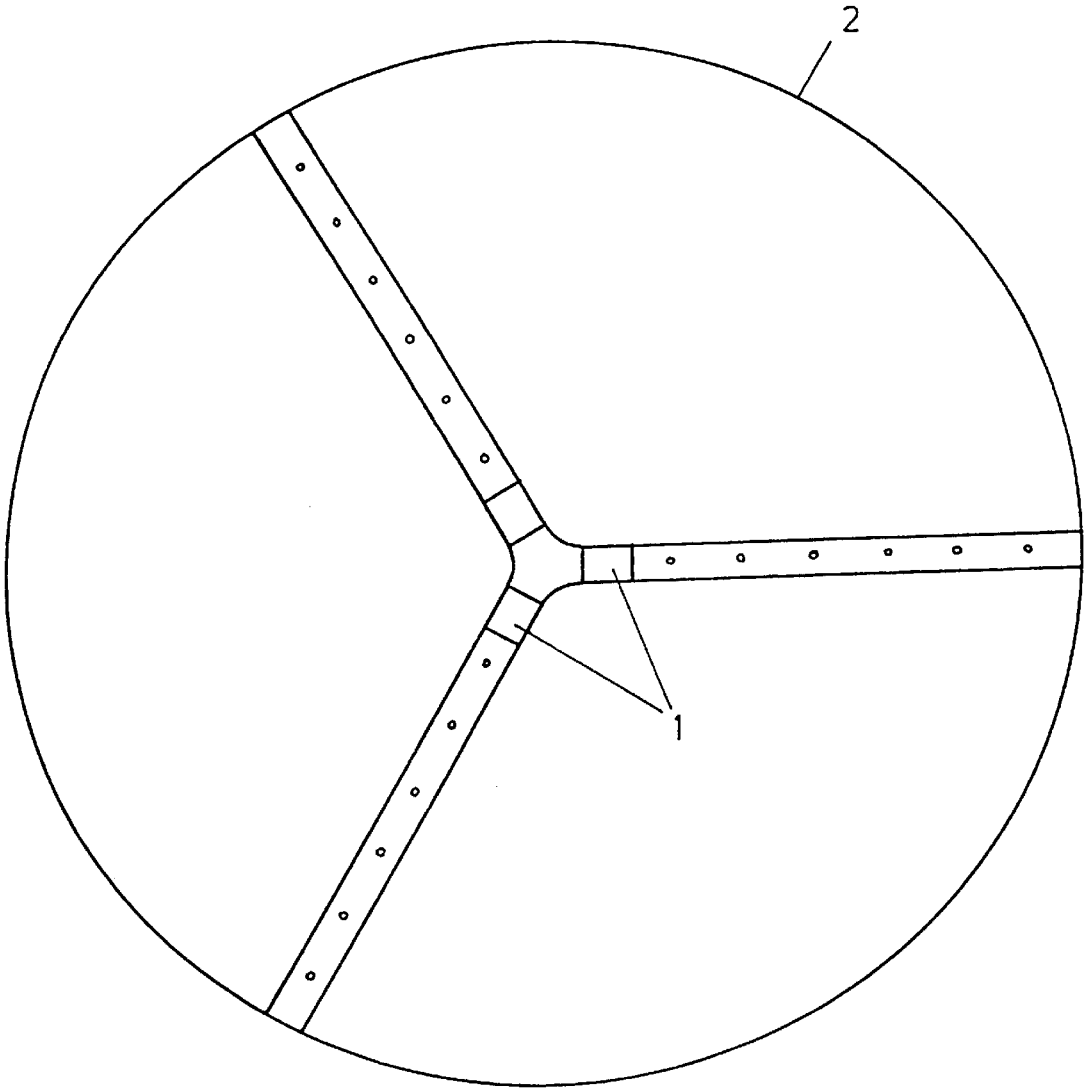
FIG. 4 shows another alternative embodiment of the present invention, in which the sound tunnels are arranged in a star formation.

FIG. 4 shows a boundary layer microphone of the present invention with sound tunnels and holes 3 arranged in a star formation. A separate sound transducer 1 is allocated to each of the sound tunnels.

Figure 5:
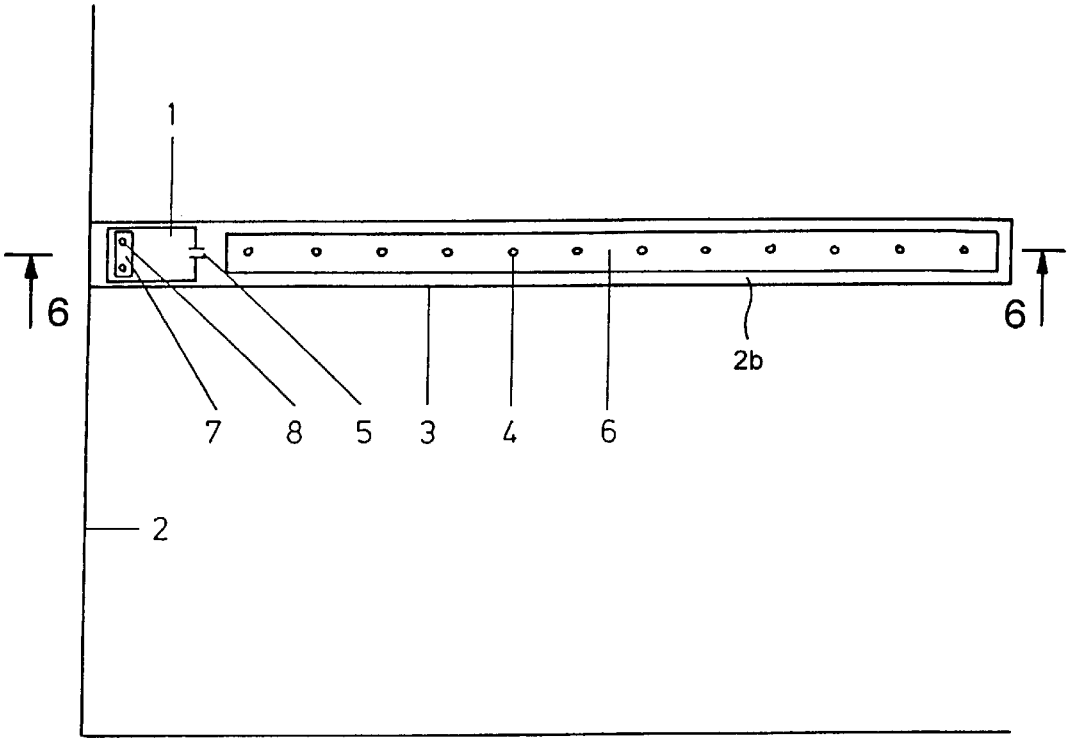
FIG. 5 is an enlarged view of the boundary layer microphone shown in FIG. 1.

FIG. 5 is a magnified view of the boundary layer microphone shown in FIG. 1. It can be clearly seen that the sound transducer 1 located in the sound tunnel 3 has a first sound inlet 5 pointing into the sound tunnel, in addition to which there is a further sound inlet 7 in the plate, which inlet leads to the rear sound inlets of the sound transducer 1, which is a directional microphone capsule in the example shown. The openings 4 in the sound tunnel are covered with a damping material 6.

Figure 6:
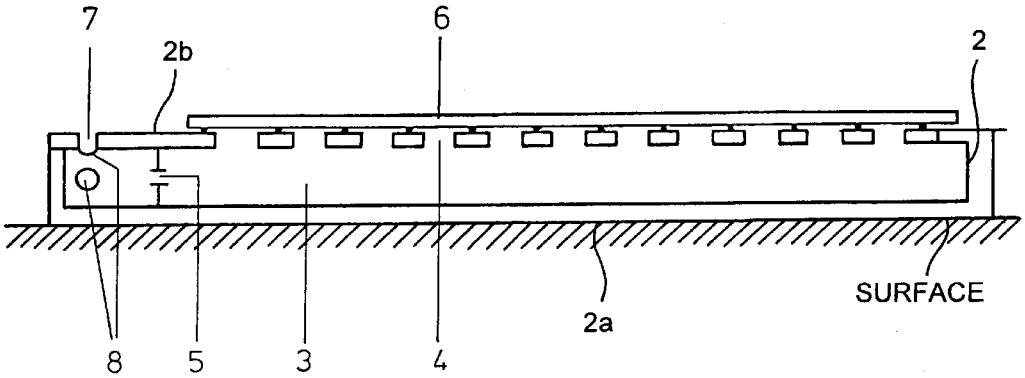
FIG. 6 is a cross-section of the boundary layer microphone shown in FIG. 5.

FIG. 6 is a cross-section of the boundary layer microphone shown in FIG. 5, along the line A—A. Here, it can be seen more clearly than in FIG. 5 that the two sound inlets 8 at the rear of the sound transducer 1 point in different directions at right angles to the first sound inlet 5. The damping material 6 may be any sound-absorbing material known in the electroacoustical field. In the example shown, the damping material consists of a lengthways strips that covers the sound inlets 4 and is bonded to the plate 1. In FIG. 6, two surfaces of plate 2 are identified as 2*a* and 2*b* (FIG. 5 also identifies surface 2*b*).

Figure 7:
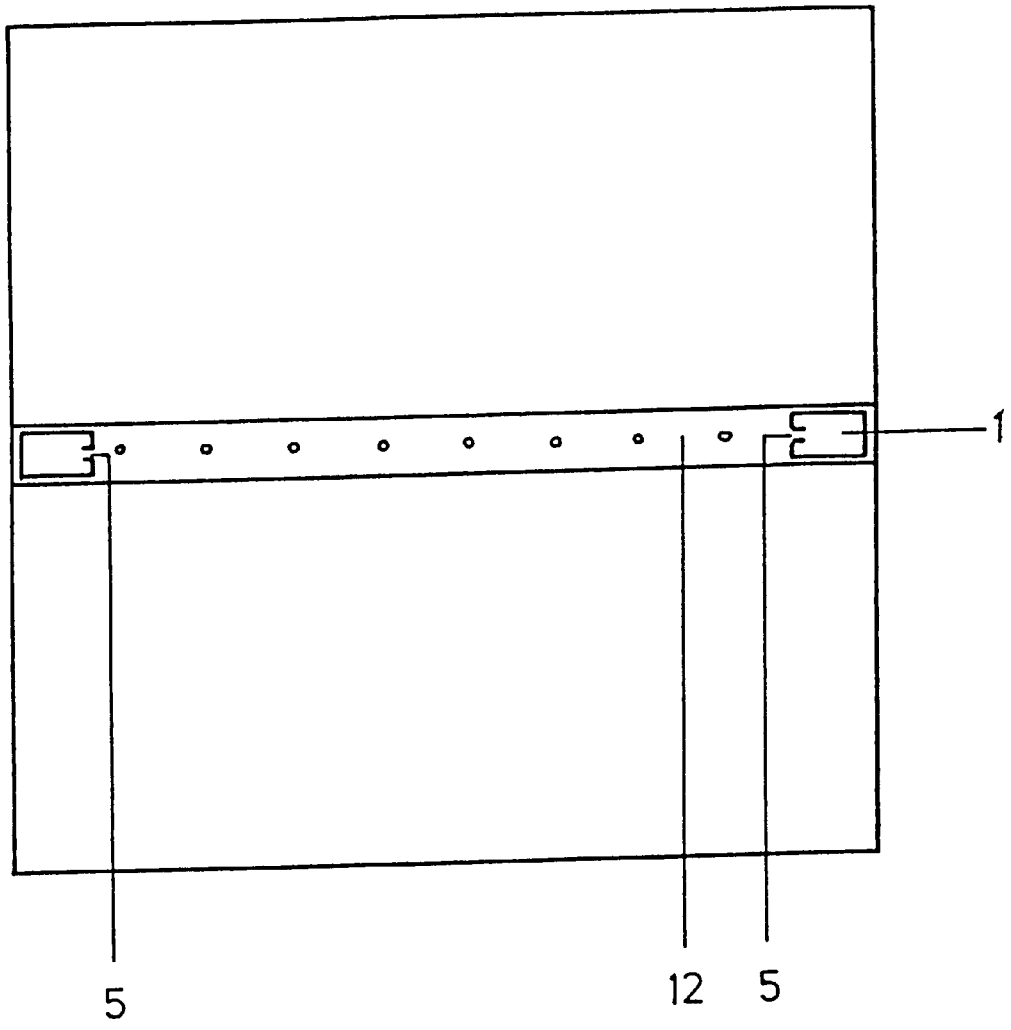
FIG. 7 is another alternative embodiment of the boundary layer microphone of the present invention shown in FIG. 1.

FIG. 7 shows a boundary layer microphone having a through hole 12 serving as a sound tunnel. At both ends of the sound tunnel transducers 1 being arranged, the first sound inlets 5 of which being directed opposite to each other.

Figure 8:
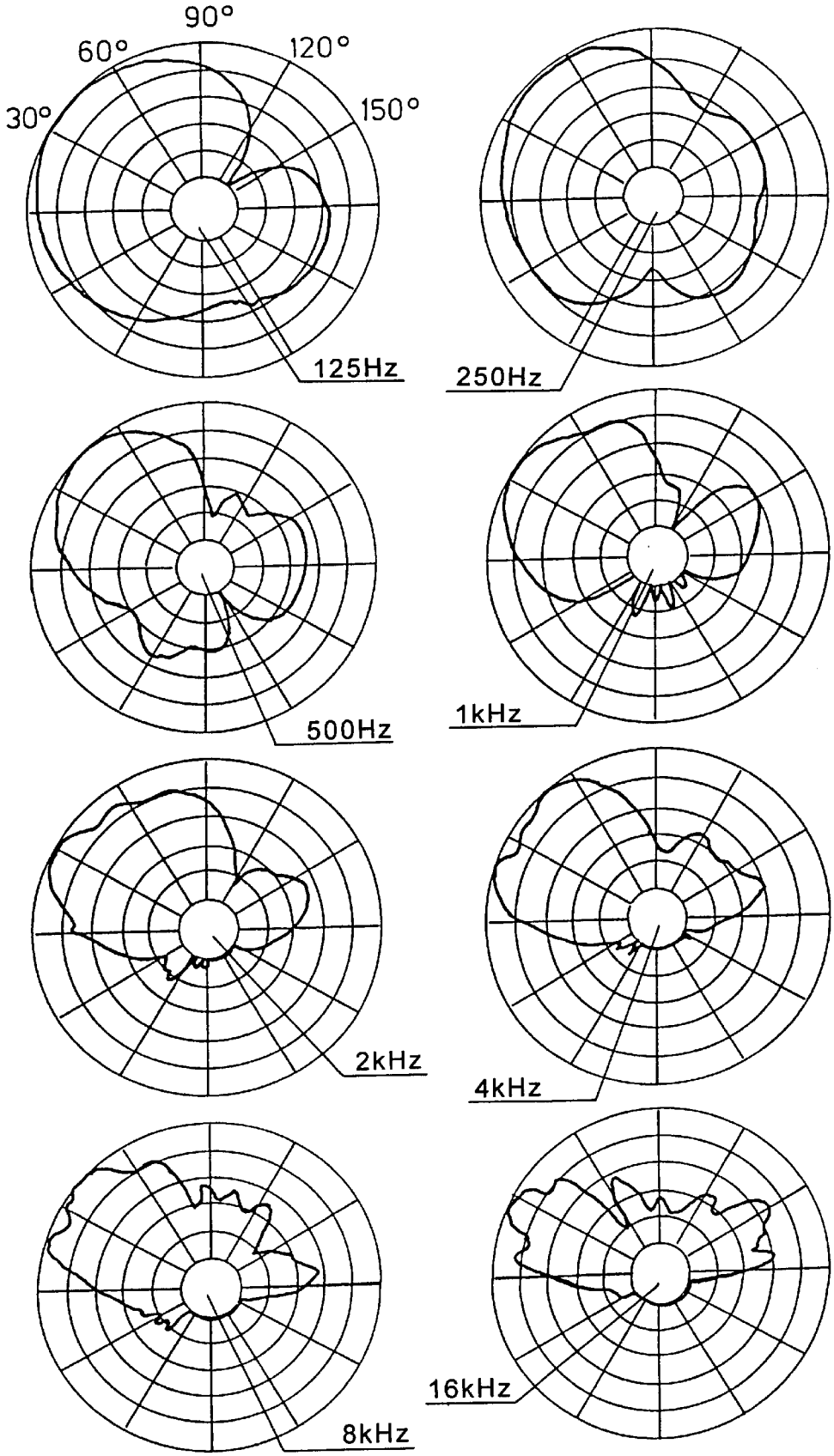
FIG. 8 illustrates eight different directional patterns for a predefined frequency range.

FIGS. 8, 9, 10 and 13 show measurements in which the respective microphone is mounted on a square-shaped boundary surface with a surface area of around 1 square meter. At frequencies below about 500 Hz, the finite dimensions of this boundary surface become clearly evident, such that their influence declines and the frequency response curves deviate from the ideal curve for boundary surfaces of infinite proportions. FIG. 8 shows the directional characteristics at eight different frequencies of the boundary layer microphone shown in FIG. 1. The frequency response diagram in FIG. 9*a* shows frequency responses of the boundary layer microphone of the present invention with a very short sound tunnel only 66 mm in length, at different incident angles. In FIG. 9*c*, the angles referred to are related to the various directions from which the sound emanates. It is clear from the diagram that the sensitivity of the boundary layer microphone is significantly higher and more evenly distributed when the incident angle is 300 than when the incident angle is 120°. The excellent bass response is not seen clearly until a comparison is made with the frequency response diagram for the MKE 212, the frequency range of which would extend down to 20 Hz under ideal conditions (see above) without adverse effects.

Figure 9A:
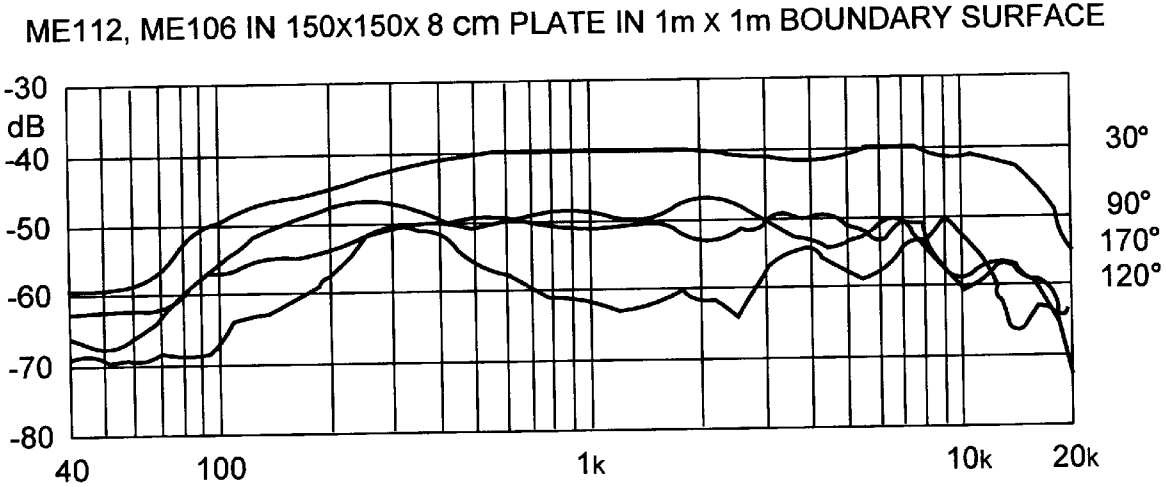
FIG. 9*a* is a frequency response curve at different incident angles for a boundary layer microphone of the present invention.
Figure 9B:
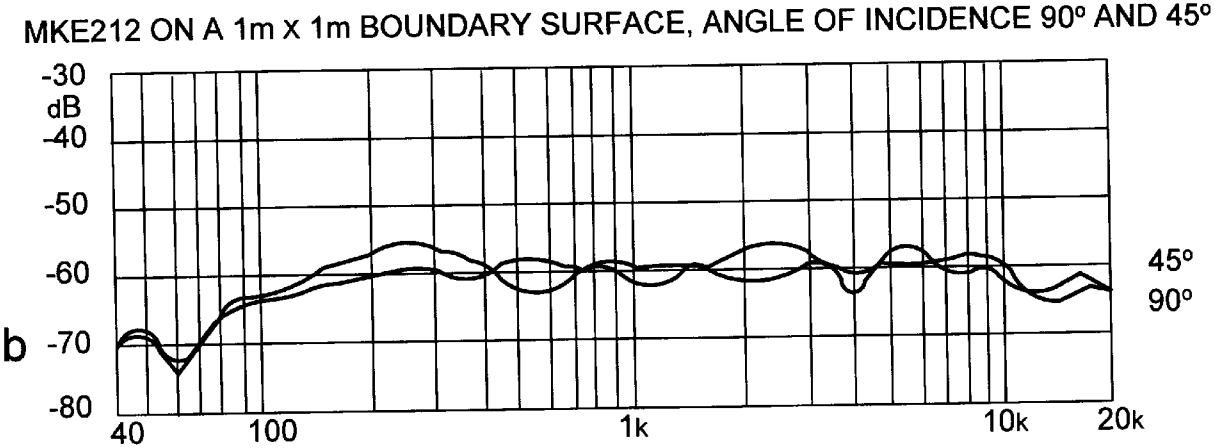
FIG. 9*b* is a frequency response diagram of a known boundary layer microphone.
Figure 9C:
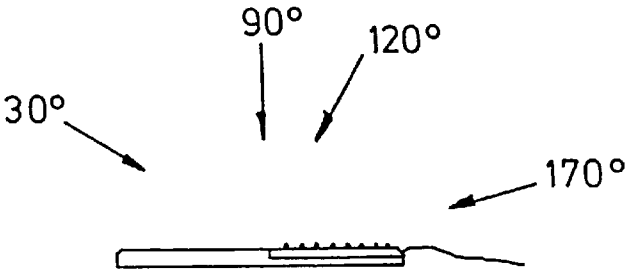
FIG. 9*c* shows the specific angles of incident sound corresponding to the diagram in FIG. 9*a;*

The directional characteristics of the known MKE 212 microphone are shown in the frequency response diagram of FIG. 9*b*.

Figure 10:
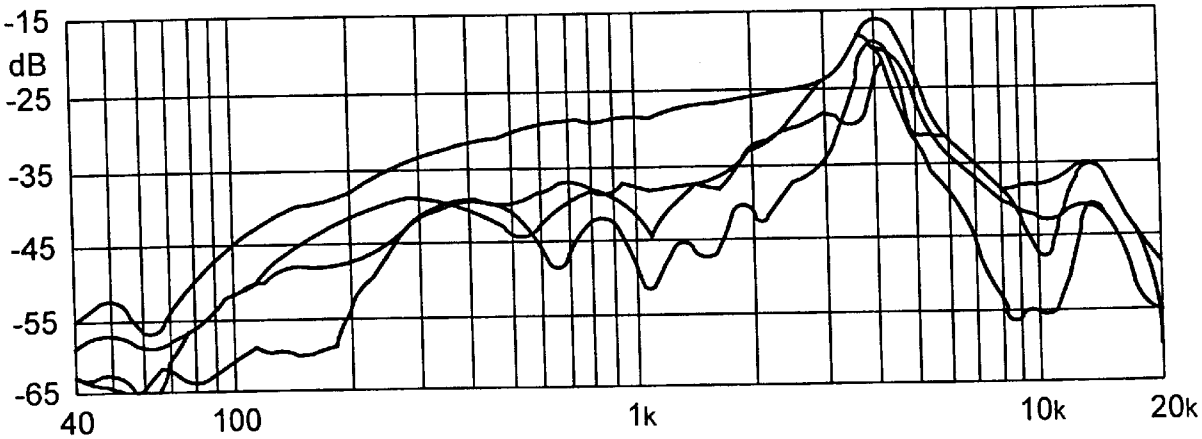
FIG. 10 shows a frequency response diagram of a known boundary layer microphone comprising a cardioid microphone.

FIG. 10 shows a frequency response diagram of a typical boundary layer microphone comprising a cardioid microphone. Its drawbacks are clearly seen when compared with FIG. 9*a*.

Figure 11:
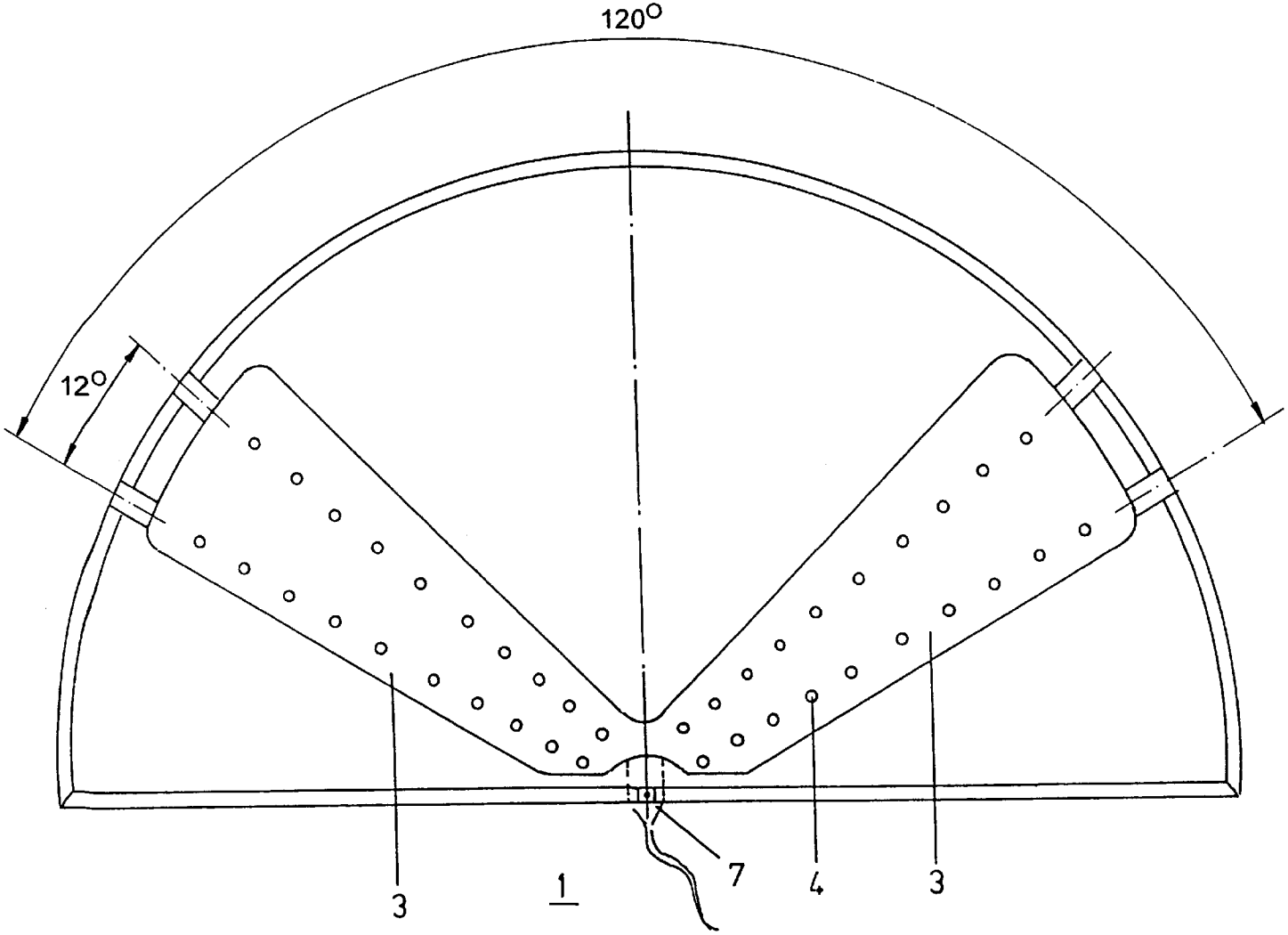
FIG. 11 is a view from above showing an embodiment of a boundary layer microphone of the present invention with two sound tunnels arranged at an angle of 120° to each other.

FIG. 11 is a view from above showing an embodiment of a boundary layer microphone of the present invention having two sound tunnels arranged at an angle of 120° to each other. The two sound tunnels open into a section that is common to both, wherein a microphone capsule is located.

Figure 12A:
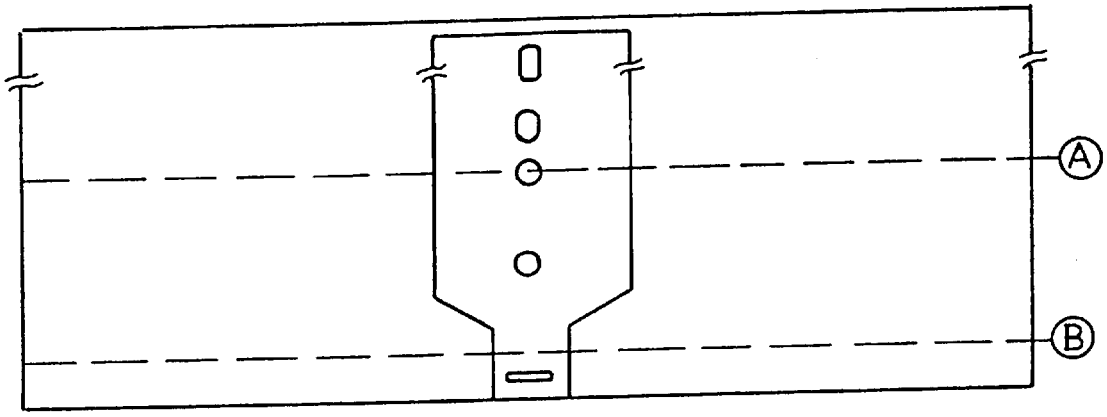
FIG. 12*a* is a view showing an alternative embodiment of a boundary layer microphone of the present invention.
Figure 12B:
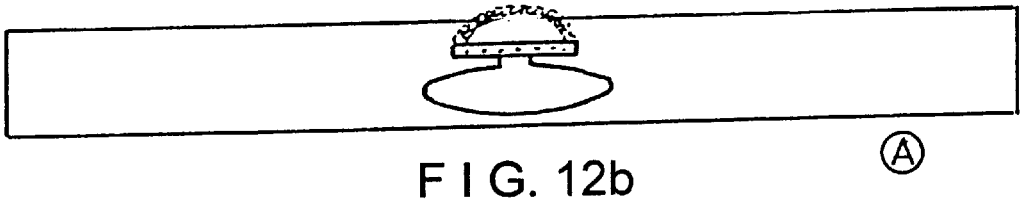
FIG. 12*b* is a sectional view taken on line A of FIG. 12*a;*
Figure 12C:
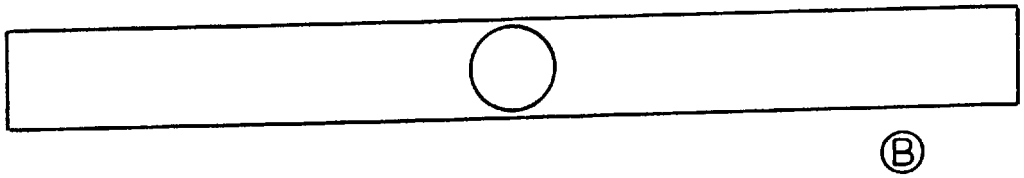
FIG. 12*c* is a sectional view taken on line B of FIG. 12*a*.

FIGS. 12*a–c* are views showing an embodiment of a boundary layer microphone of the present invention having a sound tunnel with an enlarged cross-section extending into the plate to the left and right. This alternative has the advantages described in the foregoing, by means of which the interference effect is ensured in the case of very long sound tunnels mounted in thin plates.

FIG. 13*a* is the directional pattern corresponding to the boundary layer microphone shown in FIG. 11, here as an amplitude frequency diagram for a situation in which the boundary layer microphone is exposed to sound waves with an incident angle of 30°, and the microphone is rotated about its own axis. The desired asymmetry can be clearly seen in FIG. 13*a*.

In FIG. 13*b*, the embodiment of the boundary layer microphone shown in FIG. 11 is again exposed to sound with an incident angle of 30°, but this time the rotation is around the axis perpendicular to the boundary surface. FIG. 13*c* shows the change in sensitivity at different vertical angles of incidence. FIGS. 11*a–c* show that the maximum sensitivity of the boundary layer microphone is at incident angles of less than 30° from the boundary surface and extending to the right and left.

It is possible, of course, to have an embodiment of the boundary layer microphone having several microphone capsules and to assign a separate output signal to each of the sound tunnels thus formed. Moreover, it is also possible to add or subtract the signals from the individual microphone capsules, or to assign several sound tunnels in the arrangements described above to only one microphone capsule, e.g., FIG. 11, in order to attain a directional response that is particularly well suited to a certain recording situation. The recording angle is then increased to the left or right according to the angle that is bound by the sound tunnels in their entirety. The suppression of unwanted sound traveling vertically to the plate is retained. In this way, a preferred recording direction can be produced, which protrudes from the plate like an oval ball with an angle of approximately 30°. This enables a speaker or group of musicians, for example, to be recorded in full using only one microphone, or to permit a single actor greater mobility while still filtering out wanted sounds. The separate sound tunnels may be progressively widened towards the end situated opposite the microphone capsule. The sound inlets in the tunnels may be arranged in long rows of holes that are situated increasingly close to each other towards the capsule, or an array of holes with an even distribution in the simplest case. In this way, the volume of the tunnels is expanded, as in the oval cross-section enlargements described above.

The problems afflicting the MKE 212—insufficient directionality with unfavorable dependency of frequency response on directional characteristics, uneven frequency response, inadequate bass response and high noise levels—can be avoided by using the boundary layer microphone of the present invention, as shown in FIG. 9*a*. By integrating a tube-type directional microphone into a boundary surface, it is possible, as shown in FIG. 9*a*, to attain a particularly high level of directionality at very high frequencies, whereby the frequency response curve is flattened out over the entire frequency range, the bass response is good, the noise level is very low, and the design of the present invention enables a boundary layer microphone to be inconspicuous without being inferior to the MKE 212 in any way under operational conditions.

While the foregoing description and drawings represent the preferred embodiments of the present invention, it will be obvious to those skilled in the art that various changes and modifications may be made therein without departing from the true spirit and scope of the present invention.

What is claimed is:

1. A boundary layer microphone having a main direction of response, said boundary layer microphone comprising:

a plate having a first surface adapted to be placed on a room surface, and a second surface;

said plate having at least one elongated interference tube having a longitudinal axis, said interference tube being open along its longitudinal axis to said second surface and running substantially parallel to and underneath said second surface of said plate; and a sound transducer being located at an end of and inside the interference tube, said sound transducer having a first sound inlet pointing into the interference tube, and said interference tube extending with its longitudinal axis along said main direction of response of said microphone.

2. The boundary layer microphone according to claim 1, wherein the interference tube openings are covered with damping material.

3. The boundary layer microphone according to claim 1, wherein the sound transducer has at least one additional sound inlet pointing in a direction different to that of the first sound inlet, and wherein the plate has at least one further sound opening leading to the second sound inlet of the sound transducer.

4. The boundary layer microphone according to claim 1, wherein the plate has several interference tubes and that each interference tube is allocated a sound transducer.

5. The boundary layer microphone according to claim 4, wherein the interference tubes are arranged in a star formation at an angle of approximately 75–225° to each other.

6. The boundary layer microphone according to claim 1, wherein a sound transducer is located at each end of the interference tube and wherein the sound inlets of the sound transducers in a tube point in each other's direction.

7. The boundary layer microphone according to claim 1, wherein the interference tube increases in width from the sound transducer section outwards.

8. The boundary layer microphone according to claim 1, wherein the interference tube is executed as a blind hole in the plate.

9. The boundary layer microphone according to claim 1, wherein the interference tube is executed as a through hole in the plate.

10. The boundary layer microphone according to claim 1, wherein said plate has a plurality of orifices within said second surface, the orifices opening into the interference tube at different locations along a longitudinal direction of the interference tube.

* * * * *